US007624714B2

(12) United States Patent
Kurihara et al.

(10) Patent No.: US 7,624,714 B2
(45) Date of Patent: Dec. 1, 2009

(54) ENGINE LUBRICATION METHOD

(75) Inventors: Katsumi Kurihara, Nagoya (JP); Bin Guo, Shanxi (CN); Shigeo Yamamoto, Fukuyama (JP)

(73) Assignee: ETG Limited, Hong Kong (HK)

( * ) Notice: Subject to any disclaimer, the term of this patent is extended or adjusted under 35 U.S.C. 154(b) by 113 days.

(21) Appl. No.: 11/903,003

(22) Filed: Sep. 20, 2007

(65) Prior Publication Data

US 2008/0083392 A1 Apr. 10, 2008

(51) Int. Cl.
*F01M 11/02* (2006.01)

(52) U.S. Cl. ..... 123/196 M

(58) Field of Classification Search ..... 123/196 R, 123/196 M, 196 CP

See application file for complete search history.

(56) References Cited

U.S. PATENT DOCUMENTS 2,111,242 A 3/1938 Harley
5,249,556 A * 10/1993 Emmitt ..... 123/196 S
5,947,075 A 9/1999 Ryu et al.
5,950,579 A * 9/1999 Ott ..... 123/54.4
5,950,590 A 9/1999 Everts et al.
5,960,764 A * 10/1999 Araki ..... 123/196 R
5,964,198 A * 10/1999 Wu ..... 123/196 R
6,116,205 A * 9/2000 Troxler et al. ..... 123/196 R
6,213,079 B1 4/2001 Watanabe
7,287,508 B2 * 10/2007 Kurihara ..... 123/196 R
7,481,197 B1 * 1/2009 Li et al. ..... 123/196 R
2009/0013959 A1 * 1/2009 Lin ..... 123/196 M

* cited by examiner

*Primary Examiner*—Hai H Huynh
(74) *Attorney, Agent, or Firm*—Baker & Hostetler, LLP

(57) ABSTRACT

The present invention is directed to a four-cycle engine including a lightweight aluminum alloy engine block having a cylindrical bore and an oil reservoir formed therein. A crankshaft is rotatably mounted in the engine block for rotation about a crankshaft axis. A piston reciprocates within the bore and is connected to the crankshaft by a connecting rod. An oil pump driven by the cam gear, which mates with a crank gear that is driven by a crank shaft, inhales oil from the oil reservoir and the valve chamber to splash lubricate into the cylinder bore. The engine is provided with a cylinder head assembly defining a compact combustion chamber having a pair of overhead intake and exhaust ports and cooperating intake and exhaust valves and a circular arc wall which surrounds around webs of the crankshaft so that each crankshaft web splashes and causes the oil to fly to lubricate engine parts.

25 Claims, 6 Drawing Sheets

SECTION D-D

ENGINE LUBRICATION METHOD

BACKGROUND OF THE INVENTION

1. Field of the Invention

This invention relates to an engine, and more particularly, an engine lubrication method for a small four-cycle internal combustion engine which is particularly suitable for the use with portable or transportable power tools.

2. Description of the Related Art

U.S. Pat. No. 5,950,590 to Everts et al. and U.S. Pat. No. 6,213,079 to Watanabe disclose a prior art small four-cycle engine construction, which are incorporated herein by reference.

Portable power tools such as line trimmers, blower/vacuums, chain saws are mostly powered by two-cycle internal combustion engines or electric motors. Some transportable power tools such as tiller/cultivators, generators are currently powered by two-cycle or four-cycle internal combustion engines. With the growing concern regarding air pollution, there is increasing pressure to reduce the emissions of both portable and transportable power equipment. Electric motors unfortunately have limited applications due to power availability for corded products, and battery life and power availability for cordless devices. In instances where weight is not an overriding factor such as lawn mowers, emissions can be dramatically reduced by utilizing heavier four-cycle engines. When it comes to power tools such as line trimmers, chain saws and blower/vacuums, four-cycle engines pose a very difficult problem. Four-cycle engines tend to be too heavy for a given horsepower output and lubrication becomes a very serious problem since portable or transportable power tools must be able to run in a very wide range of orientations except generators or tiller/cultivators. For some tiller/cultivators powered by four-cycle engines with vertical power shaft, lubrication also becomes a serious problem since it is difficult to use same lubrication system as engines with horizontal power shaft.

Therefore, it is an object of the present invention to provide a small four-cycle internal combustion engine having low emissions and is sufficiently light weight to be carried and/or transported by an operator, which is especially suitable for a hand-held or transportable power tool.

It is a further object of the present invention to provide a small four-cycle internal combustion engine having an internal lubrication system enabling the engine to be run at a wide variety of orientations typically encountered during normal operation, which is especially suitable for a portable or transportable power tool.

It is a further object of the present invention to provide a small lightweight four-cycle engine having an engine block, an overhead valve train and a lubrication system to splash oil mist to lubricate the crank case throughout the normal range of operating positions, which is especially suitable for a portable or transportable power tool.

It is yet a further object of the invention to provide a return system of lubricant to return lubrication oil into oil reservoir after lubricating parts in the crankcase and the overhead valve chamber.

These and other objects, features, and advantages of the present invention will become apparent upon further review of the remainder of the specification and the accompanying drawings.

SUMMARY OF THE INVENTION

In order to achieve the above objects, a four-cycle, internal combustion engine is provided which is suitable for the use with portable or transportable power tools. The four-cycle engine is provided with an engine block having at least one cylindrical bore oriented in a normally upright orientation having an enclosed crank shaft chamber. A crankshaft is pivotably mounted within the engine block. An enclosed oil reservoir is located below the crank shaft chamber. The enclosed oil reservoir when properly filled, enables the engine to rotate at least 30 degrees about the crankshaft axis in either direction without oil within the reservoir rising above the level of the crankshaft counter weight. A pump is connected drivably to said cam gear-cam assembly, said pump inhales lubrication oil from the oil reservoir and valve chamber to splash oil into the cylinder.

DESCRIPTION OF THE EMBODIMENTS

Figure 1:
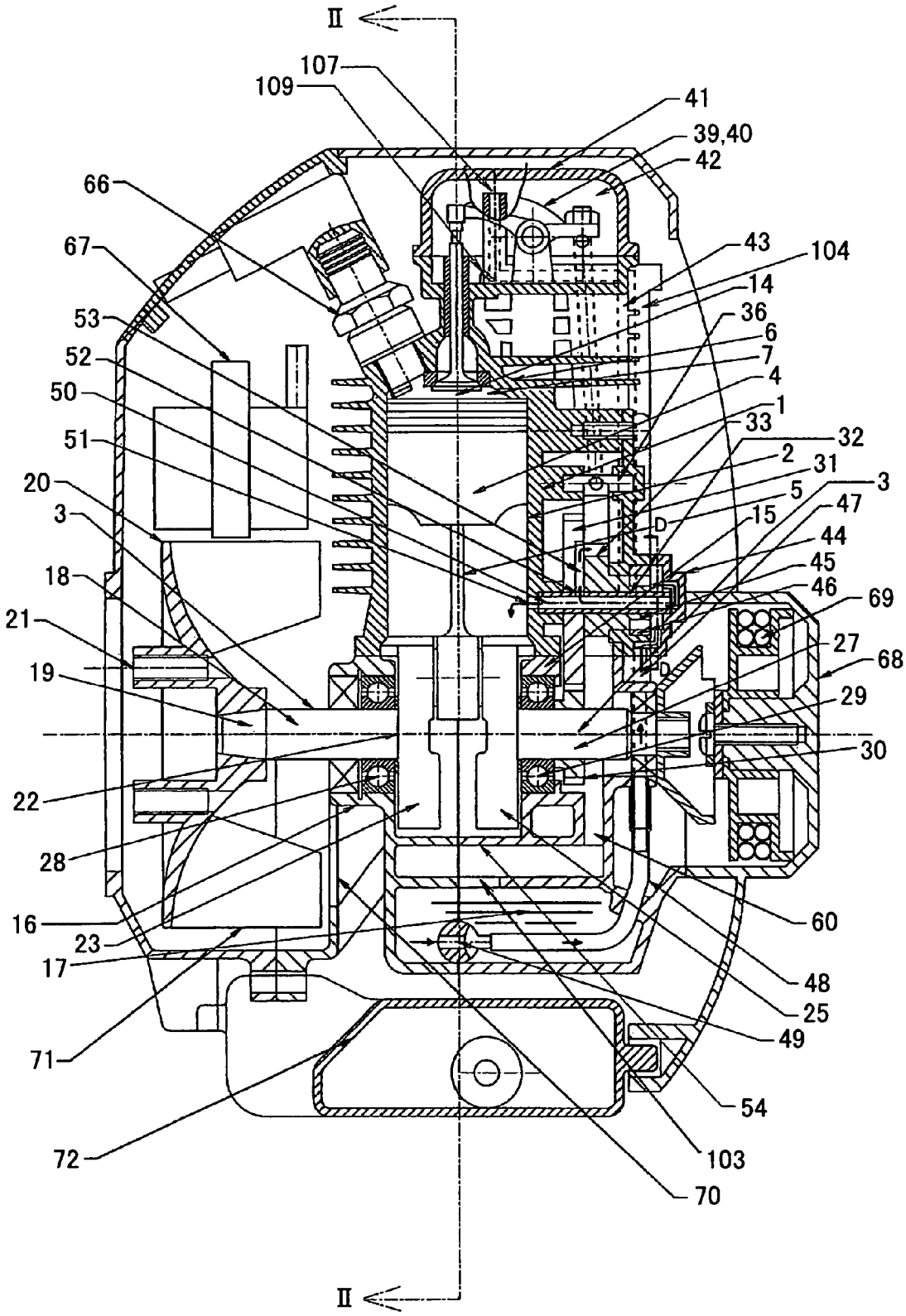
FIG. 1 is a cross-sectional side elevation of the engine taken along the rotating axis of the crankshaft and axis of cylinder bore.
Figure 2:
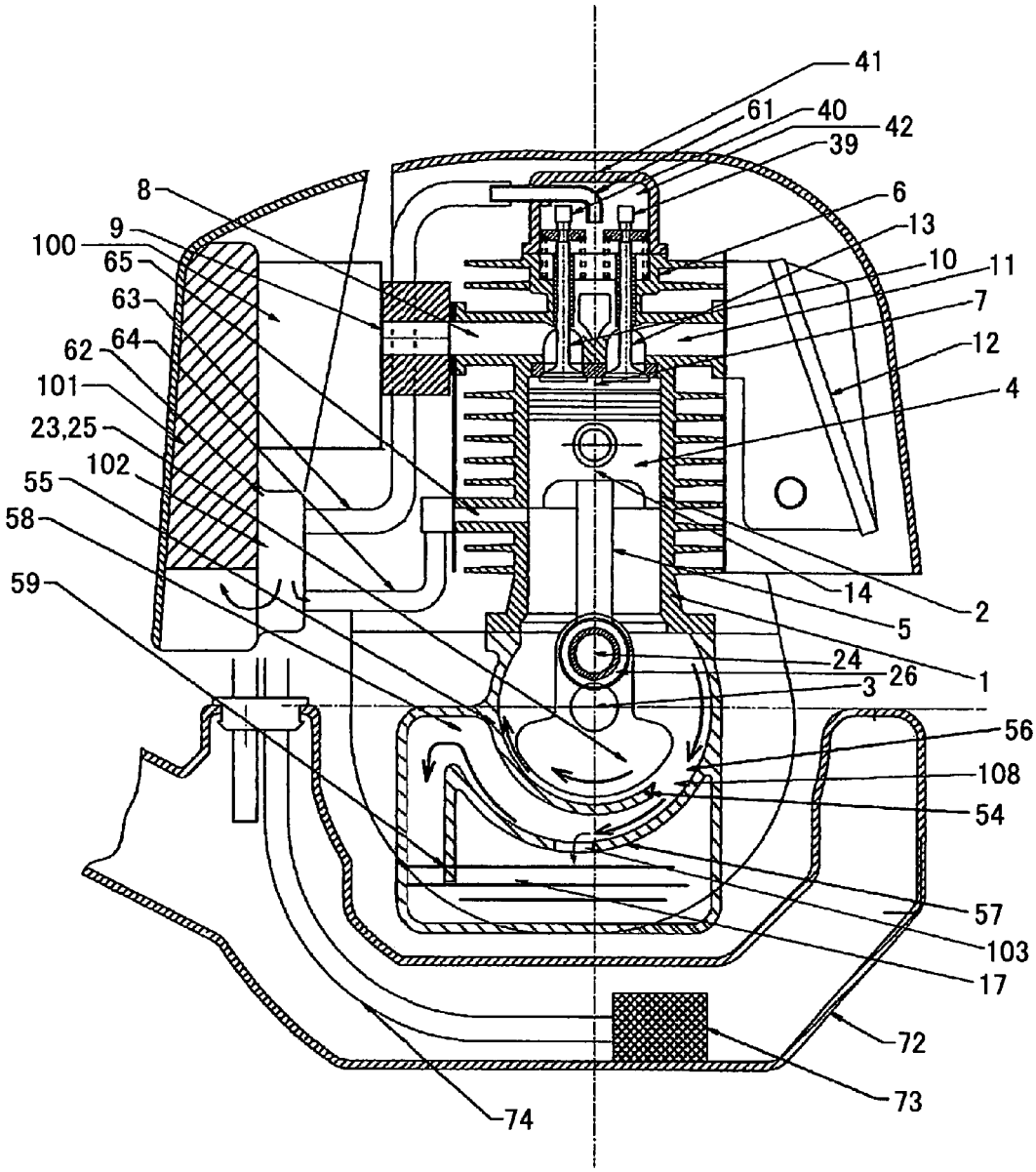
FIG. 2 is a cross-sectional side elevation view of the engine taken along line II-II in FIG. 1.

FIG. 1 and FIG. 2 illustrate a cross-sectional side elevation view of a four-cycle engine. The four-cycle engine is made up of a lightweight aluminum housing including a cylinder block 1 having a cylindrical bore 2 formed therein. A crankshaft 3 is pivotably mounted within the engine block 1 in a conventional manner. A piston 4 slides within the cylindrical bore 2 and is connected to the crankshaft by a connecting rod 5. A cylinder head 6 is affixed to the engine block 1 to define an enclosed combustion chamber 7. The cylinder head 6 is provided with an intake port 8 coupled to an insulator 9 and carburetor 100 and selectively connected to the combustion chamber 7 by an intake valve 10. 101 is a filter element of air cleaner, which eliminates dust from the intake air into the engine. The cylinder head 6 is also provided with an exhaust port 11 connected to a muffler 12 and selectively connected to the combustion chamber 7 by an exhaust valve 13.

As illustrated in FIGS. 1 and 2, the cylinder axis 14 of four-cycle engine is generally upright when in normal use. The cylinder block 1 is connected to a crankcase-A 15 and crankcase-B 16 that provide an enclosed oil reservoir 17. The crankcase-A 15 and crankcase-B 16 mate with each other at the interface containing cylinder axis 14 and form a crank shaft chamber 108. The oil reservoir 17 is relatively deep so that there is ample clearance between the crankshaft 3 and the level of the oil within the oil reservoir during normal use.

The crankshaft 3 is provided with an axial shaft member 18 having an output end 19 adapted to be coupled to a flywheel 20 which has an implement input member 21. An input end 22 of axial shaft member 18 is coupled to a counterweight web 23. A crankpin 24 is affixed to counterweight webs 23, 25 and is parallel to and radially offset from the axial shaft 18. The crankpin 24 pivotally cooperates with a roller bearing 26 mounted in connecting rod 5. The axial shaft 18 and 27 of crankshaft 3 are pivotably attached to a set of crankcase-A 15 and crankcase-B 16 by a pair of bearings 28 and 29. At the side of bearing 29 is a crank gear 30.

Figure 3:
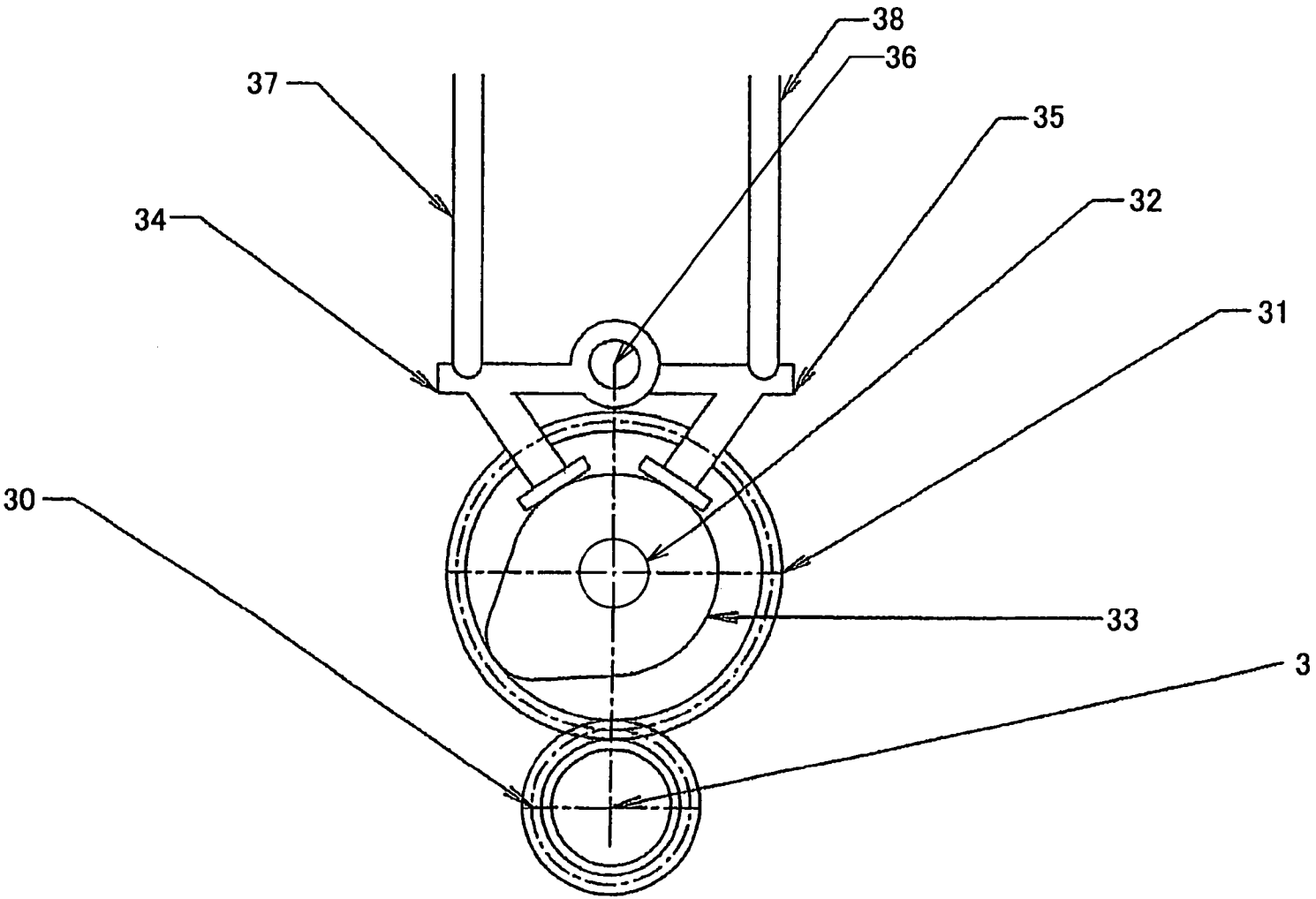
FIG. 3 is an enlarged schematic illustration of the camshaft and the follower mechanism.

The camshaft drive and valve lifter mechanism is best illustrated in FIGS. 1 and 3. The crank gear 30 is mounted on the crankshaft, which in turn drives a cam gear 31 with twice the number of teeth as the crank gear 30 resulting in the camshaft 32 rotating in one-half engine speed. The cam gear 31 is affixed to a camshaft 32 which is journaled to the cylinder block 1 and includes a rotary cam lobe 33. In the embodiment illustrated, a single cam lobe is utilized for driving both the intake and exhaust valve. Followers 34 and 35 are pivotably connected to the cylinder block 1 by a pivot pin 36.

Push rods 37 and 38 extend between camshaft followers 34 and 35 and rocker arms 39 and 40 located within the cylinder head 6. The cam, push rods 37, 38 and rocker arms 39, 40 are part of a valve train assembly. Affixed to the cylinder head 6 is a valve cover 41 which defines therebetween an enclosed valve chamber 42.

A wall 43 surrounds the intake and exhaust push rods 37 and 38 in a conventional manner in order to prevent the entry of dirt into the engine.

In order to lubricate the engine, a pump 44 such as a trochoid pump is placed at the side of cam gear 31. The pump 44 has an inner rotor 45 and an outer rotor 46. In other embodiments of the present application, a gear pump or plunger pump may be used.

The inner rotor 45 is driven by the cam gear 31 and the outer rotor 46 is rotated following the rotation of the inner rotor 45. Lubrication oil is inhaled from the passage 47. An end of the passage 47 leads to the oil entrance of the pump. The other end of passage 47 is connected to a flexible tube 48. The other end of flexible tube is connected to a filter with weight 49. By means of the weight 49, the entrance of the flexible tube is dipped in the oil in the oil reservoir 17 at any orientation of the engine.

The oil pushed out by the pump is lead to the cylinder bore through an inner hole 50 of the cam shaft 32 and a hole 51 at the cylinder wall as illustrated in FIG. 1. The other hole 52 at the wall of the cam shaft 32 leads oil to the valve actuating train through a passage 53 on the cam gear 31. Accordingly, the engine parts inside the cylinder and the valve train room are then mist lubricated by the oil splashed by means of the rotation of and/or the centrifugal force generated by the rotating parts such as web 23, 25 and the cam gear 31.

As illustrated in FIGS. 1 and 2, a first wall or a circular arc wall 54 surrounding the counterweight web 23,25 of the crank shaft 3 is extended from the wall of crankcase-A 15 and crankcase-B 16. The arc wall 54 is co-axial with the axis of the counterweight web 23 or 25. The distance between the web 23 or 25 and the inner face of the arc wall is made narrow for the reason as set forth below. The end 55 of arc wall 54, which is down stream of the rotation of web 23 or 25, is connected to the inner wall of crankcase-A 15 or crankcase-B 16, while an oil entrance 56 is provided between arc wall 54 and the wall of crankcase-A and crankcase B as illustrated in FIG. 2.

Around the entrance 56, a second wall or a scrolled wall 57 is provided. As illustrated in FIG. 2, the scrolled wall 57 is located a certain distance from the arc wall 54. This distance increases with the rotation of the crank web. The end of wall 57 located at the upper stream of rotation of counterweight web 23 or 25 is connected to the inner wall of crankcase-A 15 or crankcase-B 16. The other side of the space between the wall 54 and the wall 57 has an outlet 58, which is located at the top of the oil reservoir 17.

A hole (or holes) 103 is provided on the wall 57 at the portion near the oil reservoir to drain the oil from the scrolled surface of the wall 57 to the oil reservoir 17.

The arc wall 54 and the scrolled wall 57 are overlapped as illustrated in FIG. 2. At the corner of the scrolled wall 57 proximate the outlet 58, an extended wall 59 is provided to the oil reservoir 17.

At the side of the cylinder block 1, a drilled oil passage 104 is provided. An end of the passage 104 leads to the oil entrance of the pump together with the passage 47. The other end of passage 104 leads to upper portion in the valve chamber 42 as illustrated in FIG. 1. A small hole 109 is opened from the valve chamber to the passage 104 near the bottom surface of the valve chamber. In other embodiments of the present application, a flexible tube may be used to provide passage 104. An oil inlet 107 is provided at the end of passage 104.

Figure 6:
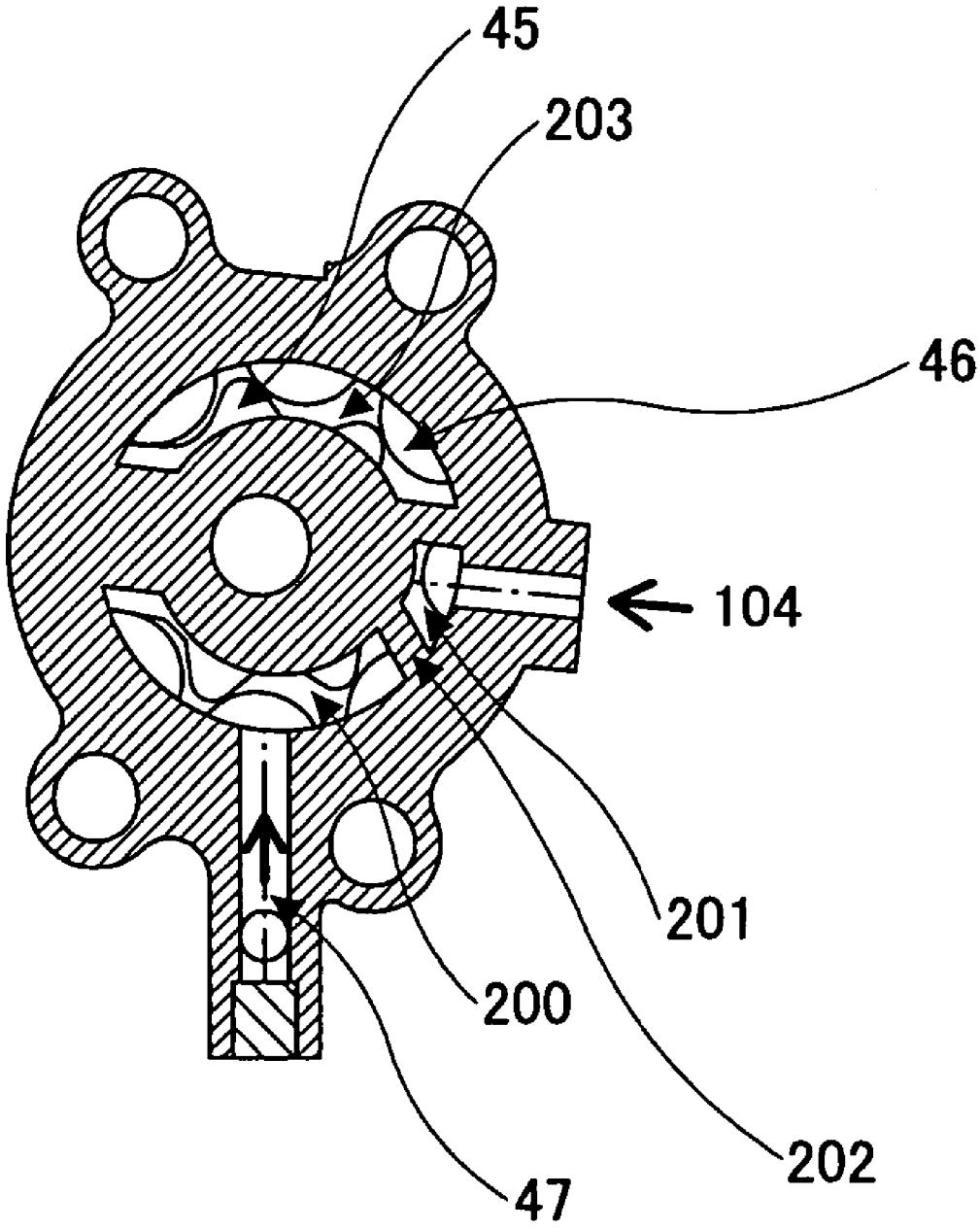
FIG. 6 is a section view of the oil pump cover that shows the detail construction of inlet cavity of the pump.

As illustrated in FIG. 6, the pump has a first inlet cavity 200 which inhales oil from the oil reservoir 17 and a second inlet cavity 201 which inhales oil from the valve chamber 42. Between the first inlet cavity 200 and the second inlet cavity 201, a wall 202 is provided to separate the cavities 200 and 201. An outlet cavity 203 provides a passage for oil to the cylinder.

In the valve chamber 42, a breather pipe 61 is opened through the valve cover 41 and is connected to an air cleaner case 62 through a breather pipe 63. In the air cleaner case 62, an oil separating deflector 102 is provided. The breathing oil mist provided through a tube is separated into oil-lean gas and oil-rich gas by the deflector 102.

A return tube 64 interconnects the air cleaner case 62 and the cylinder wall in which a return hole 65 is provided so as to open and close with a reciprocating motion of piston 4 and the oil-rich mist returns into the crankcase only when the pressure in the crankcase is negative. The oil-lean mist is inhaled to the carburetor through a filter element 101.

Other parts not specifically referenced to in the foregoing relate to conventional four-cycle engines. A spark plug 66 is installed in a spark plug hole formed in the cylinder head. A coil 67 is an ignition coil. A re-coil starter 68 having a rewinding rope 69 is provided at a side of crank shaft 3. At the lower corner of the crankcase-B 16, cooling air entrance 70 is provided which inhales cooling air for the engine generated by rotation of blade 71 on the flywheel 20.

A fuel tank 72 is provided below the oil reservoir 17, adequately spaced apart therefrom. In the fuel tank 72, a fuel filter 73 and a fuel pipe 74 are provided through which fuel is inhaled into the carburetor 100.

In order to achieve high power output and relatively low exhaust emissions, the four-cycle engine is provided with a very compact combustion chamber 7. When the engine is started by pulling the winding rope 69 as illustrated in FIG. 1, lubricating oil is immediately inhaled to the oil pump 44 by rotation of the rotors 45, 46 through flexible tube 48. Lubricating oil is splashed into the cylinder bore through the holes 50 and 51 and into the valve mechanism room through the hole 52 and the passage 53. By means of the weight supported by and connected to the flexible tube 48, oil is inhaled at any positions of the engine. The oil mist in the room, in which the valve actuating parts are installed, lubricates the valve train and then flows into the air cleaner box through the passages 61 and 63. When the pressure in the cylinder bore is negative, a port 65 at the wall of cylinder bore opens and the mist returns from the air cleaner box into the cylinder bore through passage 64. The excess oil after lubricating valve mechanism returns into oil reservoir 17 through hole 60, which is provided to connect the valve train room to the space between the are wall 54 and the scrolled wall 57.

As illustrated above, the circular arc wall 54 surrounds the counterweight webs 23, 25 a slight distance from the web. The scroll-shaped wall 57 has gradually increased distance from the circular arc wall 54 to the direction of the web and has partial overlap with the circular arc wall 54. The crankshaft webs 23 and 25 splash the oil to mist lubricate the internal engine parts. After lubricating the engine parts, as the webs 23, 25 rotate, the oil is forced to return into the oil reservoir 17 guided by the scroll-shaped wall 57 at any posture of engine due to the viscosity of the oil situated between the webs 23, 25 and the circular arc wall 54 as well as the centrifugal force generated by the webs 23, 25. Further, the oil at the scrolled wall 54 is drained through the hole 103 to the oil reservoir 17.

Figure 4:
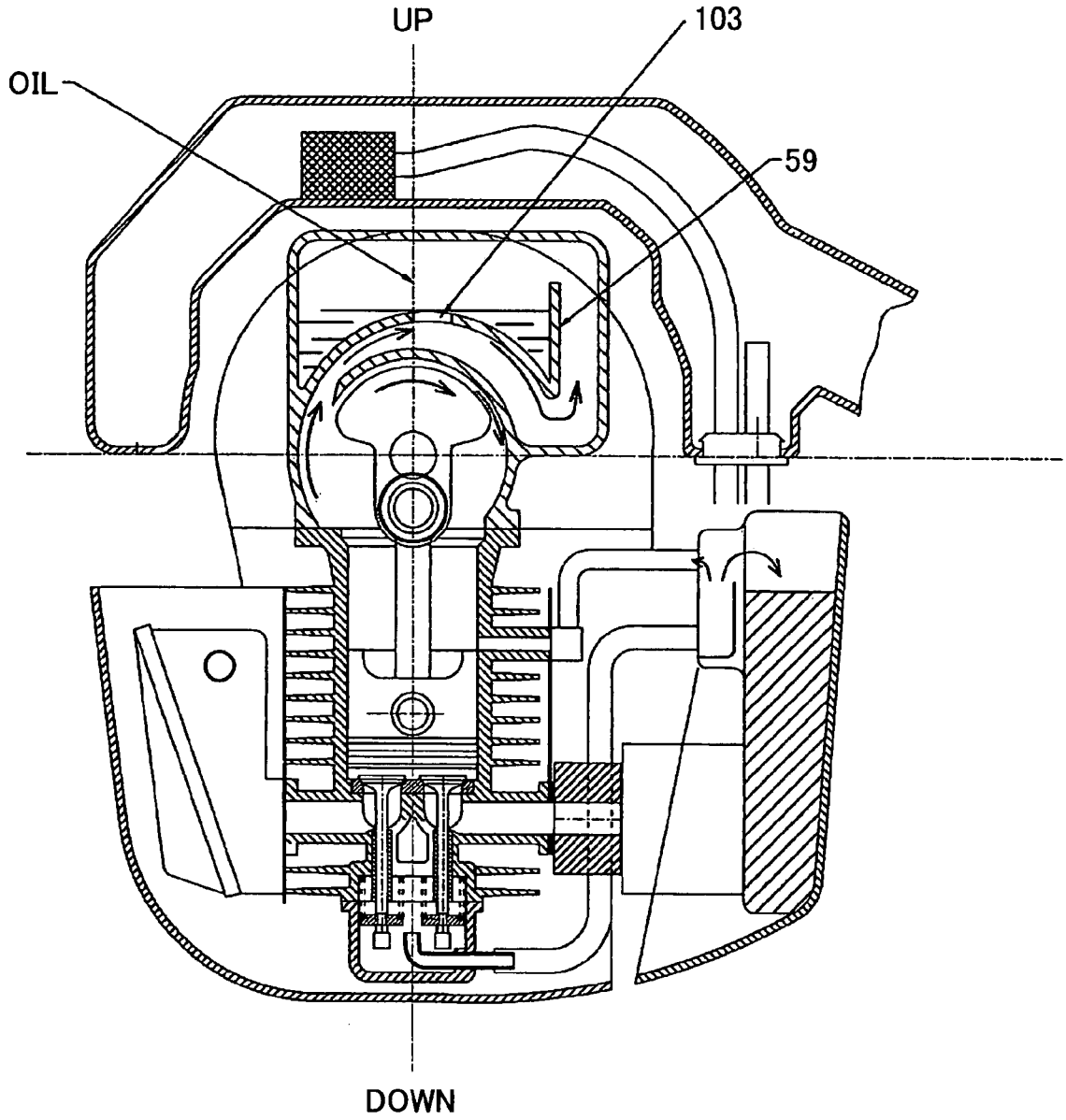
FIG. 4 is a cross-sectional side elevation view of the engine of FIG. 2 when it is oriented to be upside down.

As illustrated in FIG. 4, even when the engine is positioned upside down, lubrication oil is kept in oil reservoir 17, helped by the extended wall 59, and oil is prevented from flowing into the cylinder head part.

Figure 5:
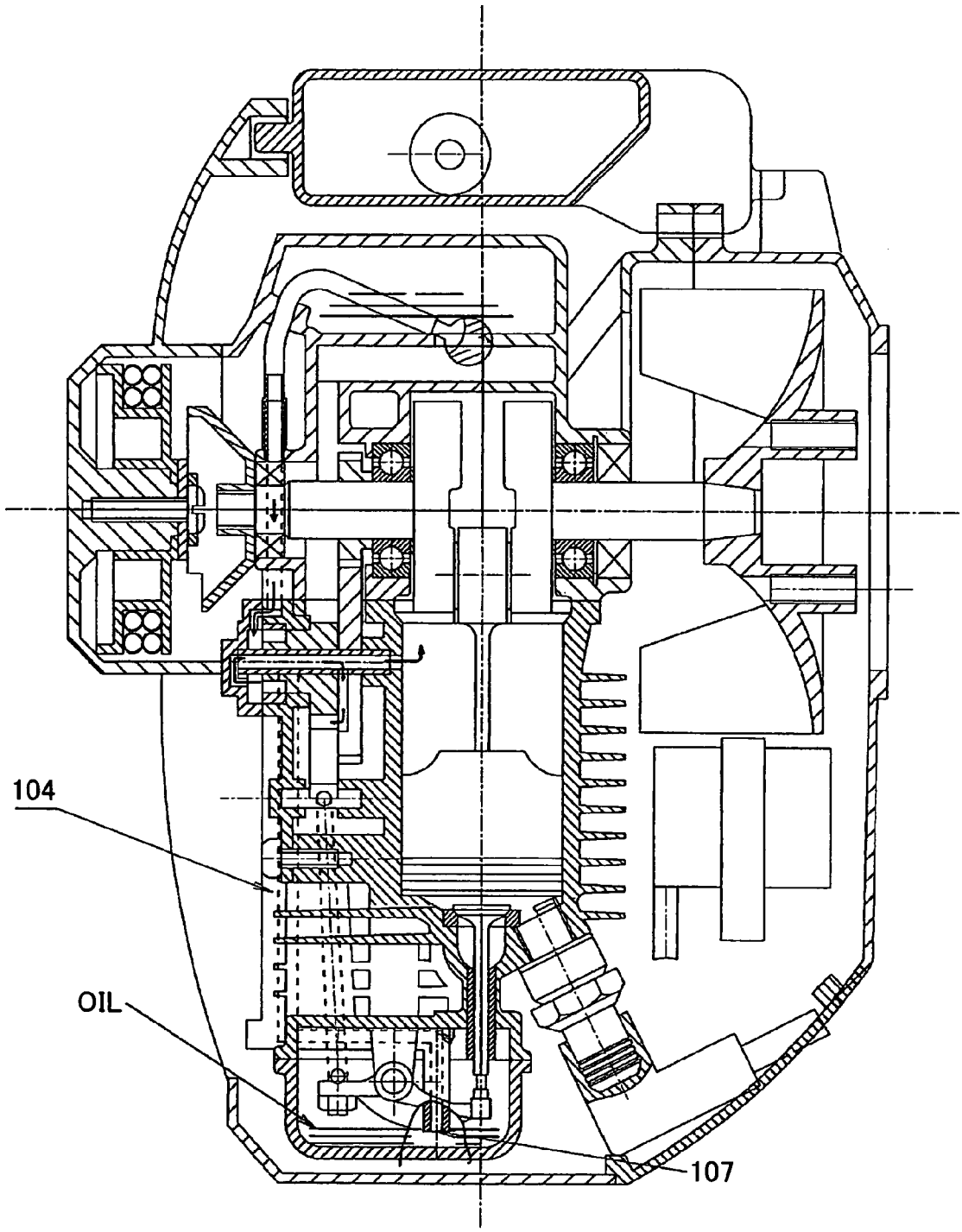
FIG. 5 is a cross-sectional side elevation view of the engine of FIG. 1 when it is oriented to be upside down.

As illustrated in FIG. 1, when the engine is in a normal orientation, the lubricating oil is inhaled from the oil reservoir 17 and through the small hole 109 in the valve chamber. Further, as illustrated in FIG. 5, when the engine is positioned upside down, the oil, after lubricating various parts in the valve chamber, is inhaled by pump 44 from the oil inlet 107 and sent to the oil reservoir 17. Accordingly, excess oil does not remain in the valve chamber.

It is believed that small light weight four cycle engines made in accordance with the present invention will be particularly suitable for the use with hand-held or transportable power tools having low emissions and is sufficiently light to be carried and/or transported by an operator. In the prior art, various kinds of lubricating methods for hand-held or transportable power tools have been presented. However, most of them require more than one complicated check valve systems to control flow of lubricating oil in the engines and to prevent oil from flowing into cylinder head when engine is positioned upside down because of the change of pressure in the crank shaft room. In the present invention, however, no additional parts are required to form the check valve mechanism because the pump 44 supplies the oil pressure and no oil pressure is required in the crankshaft chamber 108. Therefore, the engine structure is simpler, which in turn reduces weight and cost.

Further, the pump in the present invention is very low cost because it can be made easily by machining and/or injection mold process, powder compaction molding.

Another advantage of this invention is better cooling performance. In the prior arts, some engines using, so to speak, dry sump lubrication. In dry sump lubrication, over heating of oil might ruin lubrication performance. As illustrated in FIG. 2, the present invention looks like dry sump but differs in the following points. First, a lot of lubrication oil is sent by oil pump. Second, there is a space between arc and scrolled walls. This space allows to prevent heat flow between crankcase and oil reservoir and consequently oil temperature of oil in reservoir is lower than the current dry sump engines. Further, as illustrated in FIG. 1, cooling air is inhaled around the fuel tank, wherein, since temperature of oil reservoir is lower, the cooling air is not heated so much as the current dry sump engines and, as the results, engine can be cooled effectively. The improved cooling may improve emission by reducing energy to cool engine.

While the present invention is discussed in relation to the engine to be used with portable or transportable power tools, a person having ordinary skill in the art will readily realize that it can be also used with stationary power tools or equipment.

What is claimed is:

1. A single-cylinder, four-stroke cycle, spark ignition internal combustion engine for mounting on a power tool comprising:

a cylinder block having a cylinder, a cylinder head, a piston mounted for reciprocation in said cylinder, said cylinder head defining an air-fuel combustion chamber;

an air-fuel mixture intake port and an exhaust gas port in said cylinder head;

a valve cover on said cylinder head defining a valve chamber;

an intake valve and an exhaust valve mounted in said intake and exhaust port, respectively, for reciprocation between port-open and port-closed positions;

a valve-actuating valve train, said valve train including at least one rocker arm and at least one valve train push rod assembly extending therefrom within said valve chamber and engaging said rocker arm;

a crankshaft rotatably mounted in a crankcase, said crankshaft includes a crank portion and at least one counterweight web;

a connecting rod having articulated connections at one end thereof to said piston and at an opposite end thereof to said crank portion, thereby forming a piston-connecting rod crankshaft assembly;

at least one cam being drivably connected to said crankshaft, said at least one cam having a cam gear and being driven at one-half crankshaft speed, the opposite end of said push rod assembly being drivably connected to said cam whereby said push rod assembly is actuated with a reciprocating motion upon rotation of said at least one cam;

a lubrication oil reservoir formed below the crankcase;

an oil pump connected drivably to said cam gear-cam assembly, said pump inhales lubrication oil from said oil reservoir and valve chamber and splashes the oil into the cylinder and the valve chamber to lubricate the engine parts inside the cylinder and the valve chamber.

2. The engine set forth in claim 1 further comprising an air cleaner box connected to said valve chamber via a first passage through which breathing oil mist gas flows, a second passage connecting the air cleaner box to the crankcase or cylinder block, and a valve being provided at the entrance of said passage into the crankcase, wherein the opening of the valve is controlled by reciprocating motion of said piston, and wherein said valve opens when pressure in the crankcase is negative and closes when the pressure in the crankcase is positive, thereby the oil mist flow control valve structure establishing a lubrication oil mist flow circuit from said valve chamber to said crankcase or said cylinder block through said air cleaner box.

3. The engine set forth in claim 1, wherein said oil pump is integrally attached with cam or cam gear.

4. The engine set forth in claim 1, wherein said oil pump is a trochoid pump.

5. The engine set forth in claim 1, wherein said oil pump is a gear pump.

6. The engine set forth in claim 1, wherein said oil pump is a plunger pump.

7. The engine set forth in claim 1, wherein said oil pump has two separated inlet cavities.

8. A hand-held, transportable, or stationary power tools driven by the engine set forth in claim 1, wherein said power tools are driven by horizontal or vertical or inclined power shaft.

9. A single-cylinder, four-stroke cycle, spark ignition internal combustion engine for mounting on a power tool comprising:

a cylinder block having a cylinder, a cylinder head, a piston mounted for reciprocation in said cylinder, said cylinder head defining an air-fuel combustion chamber;

an air-fuel mixture intake port and an exhaust gas port in said cylinder head;

a valve cover on said cylinder head defining a valve chamber;

an intake valve and an exhaust valve mounted in said intake and exhaust port, respectively, for reciprocation between port-open and port-closed positions;

a valve-actuating valve train, said valve train including at least one rocker arm and at least one valve train push rod assembly extending therefrom within said valve chamber and engaging said rocker arm;

a crankshaft rotatably mounted in a crankcase, said crankshaft includes a crank portion and at least one counterweight web;

a connecting rod having articulated connections at one end thereof to said piston and at an opposite end thereof to said crank portion, thereby forming a piston-connecting rod crankshaft assembly;

at least one cam being drivably connected to said crankshaft, said at least one cam having a cam gear and being driven at one-half crankshaft speed, the opposite end of said push rod assembly being drivably connected to said at least one cam whereby said push rod assembly is actuated with a reciprocating motion upon rotation of said at least one cam;

a lubrication oil reservoir formed below the crankcase;

an oil pump connected drivably to said cam gear-cam assembly, said pump inhales lubrication oil from said oil reservoir and valve chamber and splashes the oil into the cylinder and the valve chamber to lubricate the engine parts inside the cylinder and the valve chamber;

a first wall at least partially surrounding said web a slight distance therefrom; and a second wall at least partially surrounding said first wall a distance gradually increasing toward the downstream of the direction of the rotation of said web;

wherein said web splashes the oil to lubricate the internal engine parts and, after lubricating the internal engine parts, the oil is forced to return into said oil reservoir guided by said second wall as the web rotates due to the viscosity of the oil between said web and the first wall.

10. The engine set forth in claim 9 further comprising an air cleaner box connected to said valve chamber via a first passage through which breathing oil mist gas flows, a second passage connecting the air cleaner box to the crankcase or cylinder block, and a valve being provided at the entrance of said passage into the crankcase, wherein the opening of the valve is controlled by reciprocating motion of said piston, and wherein said valve opens when pressure in the crankcase is negative and closes when the pressure in the crankcase is positive, thereby the oil mist flow control valve structure establishing a lubrication oil mist flow circuit from said valve chamber to said crankcase or said cylinder block through said air cleaner box.

11. The engine set forth in claim 9, wherein said oil pump is a trochoid pump.

12. The engine set forth in claim 11, wherein said first and second walls are formed by mating a set of crankcase.

13. The engine set forth in claim 9, wherein said oil pump is a gear pump.

14. The engine set forth in claim 13, wherein said first and second walls are formed by mating a set of crankcase.

15. The engine set forth in claim 9, wherein said oil pump is a plunger pump.

16. The engine set forth in claim 15, wherein said first and second walls are formed by mating a set of crankcase.

17. The engine set forth in claim 9, wherein said oil pump has two separated inlet cavities.

18. The engine set forth in claim 17, wherein said first and second walls are formed by mating a set of crankcase.

19. A hand-held, transportable, or stationary power tools driven by the engine set forth in claim 9, wherein said power tools are driven by horizontal or vertical or inclined power shaft.

20. The engine set forth in claim 19, wherein said first and second walls are formed by mating a set of crankcase.

21. The engine set forth in claim 9, wherein said second wall has an extended wall which prevents the oil in the oil reservoir from flowing out when engine is inclined at any position.

22. The engine set forth in claim 21, wherein said first and second walls are formed by mating a set of crankcase.

23. The engine set forth in claim 9, wherein said first and second walls are formed by mating a set of crankcase.

24. The engine set forth in claim 9, wherein said first and second walls are formed by mating a set of crankcase.

25. The engine set forth in claim 9, wherein said second wall has an hole or holes to drain oil to the oil reservoir.

* * * * *